US005551121A

United States Patent [19]

Vazquez, Jr.

[11] Patent Number: 5,551,121

[45] Date of Patent: Sep. 3, 1996

[54] SQUEEGEE-TYPE MOPPING DEVICE

[76] Inventor: Rafael Vazquez, Jr., 2514 N. Marshfield, Chicago, Ill. 60614

[21] Appl. No.: 500,105

[22] Filed: Jul. 10, 1995

[51] Int. Cl.[6] ..... A47L 5/02

[52] U.S. Cl. ..... 15/341; 15/344; 15/350; 15/401

[58] Field of Search ..... 15/322, 341, 344, 15/350, 401; 401/176

[56] References Cited

U.S. PATENT DOCUMENTS

| | | | |
|---|---|---|---|
| 770,762 | 9/1904 | Lipp | 15/341 |
| 1,014,776 | 1/1912 | Rubel | 15/341 |
| 1,263,299 | 4/1918 | Wemhoener | 15/341 |
| 4,168,562 | 9/1979 | Maasberg | 15/322 |

FOREIGN PATENT DOCUMENTS

| | | | |
|---|---|---|---|
| 102290 | 11/1916 | United Kingdom | 15/341 |

*Primary Examiner*—Frankie L. Stinson
*Assistant Examiner*—Terrence R. Till

[57] ABSTRACT

A squeegee-type mopping device including an elongated tubular rigid container having an open upper end and an open lower end; a head having a hollow interior, an upper open extent coupled to the lower end of the container to allow communication therebetween, a lower extent having a peripheral lower edge bounding an opening that allows access to the interior, and a flexible blade removably coupled to the lower edge and extended downwards therefrom; and an elongated plunger having an upper end and a lower end and with the lower end slidably disposed within the container to form a moveable seal, the opening of the head positionable upon a surface covered with liquid and with extension of the plunger creating a suctioning force for pulling the liquid through the head and into the container and with retraction of the plunger ejecting water from the container and through the opening.

7 Claims, 4 Drawing Sheets

SQUEEGEE-TYPE MOPPING DEVICE

BACKGROUND OF THE INVENTION

1. Field of the Invention

The present invention relates to a squeegee-type mopping device and more particularly pertains to sucking up spills of liquid with a squeegee-type mopping device.

2. Description of the Prior Art

The use of mopping apparatuses is known in the prior art. More specifically, mopping apparatuses heretofore devised and utilized for the purpose of sucking or soaking up liquid spills are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,931,662 to Nayfa et al. discloses a floor cleaning machine with vacuum pickup. U.S. Pat. No. 3,950,813 to Buck discloses a squeegee. U.S. Pat. No. 3,992,747 to Hufton discloses a cleaning tool. U.S. Pat. No. 4,119,386 to Cushing discloses a mop assembly to distribute selected liquids on floor areas to be waxed, cleaned, and/or stripped. U.S. Pat. No. 4,136,419 to Hetman et al. discloses an apparatus for cleaning a column of windows and wall surfaces of a building. U.S. Pat. No. 4,266,317 to Duda discloses a vacuum cleaning apparatus.

While these devices fulfill their respective, particular objective and requirements, the aforementioned patents do not describe a squeegee-type mopping device that allows spilled liquids to be readily retrieved through and combination of scooping and suctioning action.

In this respect, the squeegee-type mopping device according to the present invention substantially departs from the conventional concepts and designs of the prior art, and in doing so provides an apparatus primarily developed for the purpose of sucking up spills of liquid.

Therefore, it can be appreciated that there exists a continuing need for new and improved squeegee-type mopping device which can be used for sucking up spills of liquid. In this regard, the present invention substantially fulfills this need.

SUMMARY OF THE INVENTION

In the view of the foregoing disadvantages inherent in the known types of mopping apparatuses now present in the prior art, the present invention provides an improved squeegee-type mopping device. As such, the general purpose of the present invention, which will be described subsequently in greater detail, is to provide a new and improved squeegee-type mopping device and method which has all the advantages of the prior art and none of the disadvantages.

To attain this, the present invention essentially comprises, in combination, an elongated rigid plastic tubular container having an upper open end, a lower end with a radial and inwardly extending flange projected therefrom to thereby create an axial circular bore, a fixed inner diameter, a smooth interior surface, a central axis disposed therethrough, and a fixed axial length. A rigid plastic hollow head is included and aligned along the central axis of the container. The head has a planar rectangular horizontal upper wall with a pair of opposed long edges, a pair of short edges, a pair of side edges extended therebetween, and a circular bore formed thereon. The head also includes a pair of opposed spaced upstanding trapezoidal-shaped long side walls with each long side wall having a short top edge, a long bottom edge, and a pair of side edges extended therebetween and with the top edges thereof interconnected with the long edges of the upper wall. The head additionally includes pair of opposed spaced upstanding trapezoidal-shaped short end walls with each end wall having a long top edge interconnected with one of the short edges of the upper wall, a short bottom edge positioned in planar alignment with the bottom edges of the side walls, and a pair of side edges extended therebetween and with the side edges of each of the end walls interconnected with the opposing side edges of the opposing side walls. The bottom edges of the side walls and the bottom edges of the end walls in combination create a peripheral lower edge bounding a rectangular opening that allows access to the interior. The head further has a flexible foam rubber blade removably coupled to the lower edge through use of a snap-type fastener. The blade is extended downwards and around the opening. The blade further has a generally triangular cross-section with a lower pointed edge extent.

A tubular rigid plastic neck is provided and aligned along the central axis of the container. The neck is interconnected between the lower end of the container and the upper wall of the head to allow communication between the container and the head through the bores. Lastly, an elongated tubular rigid plastic plunger is aligned along the central axis of the container. The plunger having an axial length greater than that of the container, a fixed diameter of a size less than the inner diameter of the container, an upper end with a crosswise bore disposed therethrough to create a handle for allowing a user a firm grip, a lower end with a flange extending radially outwards therefrom, and a flexible rubber ring fit around a peripheral extent of the flange. The lower end of the plunger is slidably disposed within the container with the rubber ring in facing contact with the interior surface of the container to form a moveable seal. The opening of the head is positionable upon a surface covered with liquid and with upward extension of the plunger creating a suctioning force for pulling the liquid through the head and into the container and with the downward retraction of the plunger ejecting the water from the container and through the opening.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved squeegee-type mopping device which has all the advantages of the prior art mopping apparatuses and none of the disadvantages.

It is another object of the present invention to provide a new and improved squeegee-type mopping device which may be easily and efficiently manufactured and marketed.

It is a further object of the present invention to provide a new and improved squeegee-type mopping device which is of durable and reliable construction.

An even further object of the present invention is to provide a new and improved squeegee-type mopping device which is susceptible of a low cost of manufacture with regard to both materials and labor, and which accordingly is then susceptible of low prices of sale to the consuming public, thereby making such a squeegee-type mopping device economically available to the buying public.

Still yet another object of the present invention is to provide a new and improved squeegee-type mopping device which provides in the apparatuses and methods of the prior art some of the advantages thereof, while simultaneously overcoming some of the disadvantages normally associated therewith.

Even still another object of the present invention is to provide a new and improved squeegee-type mopping device for sucking up spills of liquid.

Lastly, it is an object of the present invention to provide a new and improved squeegee-type mopping device comprising an elongated tubular rigid container having an open upper end and an open lower end; a head having a hollow interior, an upper open extent coupled to the lower end of the container to allow communication therebetween, a lower extent having a peripheral lower edge bounding an opening that allows access to the interior, and a flexible blade removably coupled to the lower edge and extended downwards therefrom; and an elongated plunger having an upper end and a lower end and with the lower end slidably disposed within the container to form a moveable seal, the opening of the head positionable upon a surface covered with liquid and with extension of the plunger creating a suctioning force for pulling the liquid through the head and into the container and with retraction of the plunger ejecting water from the container and through the opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
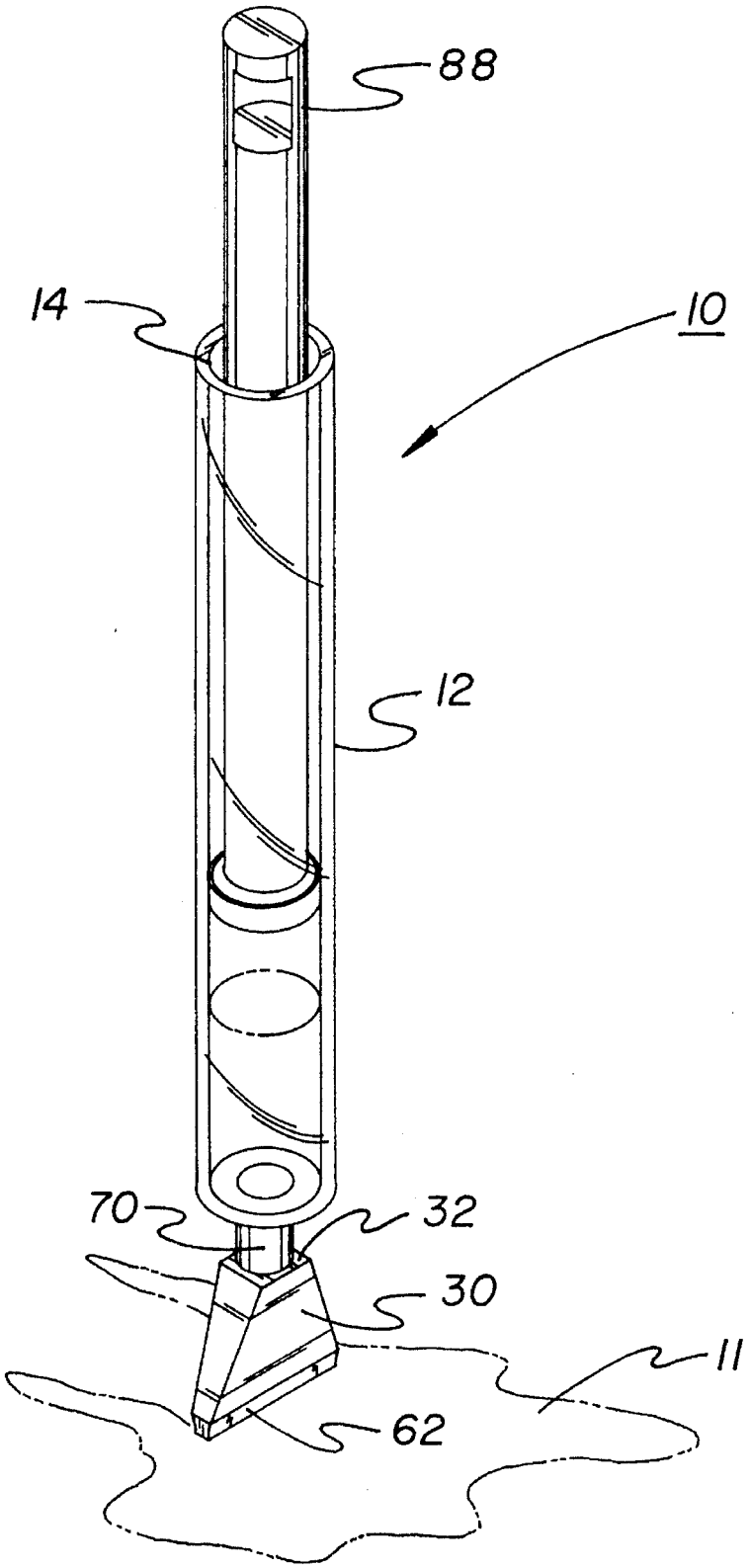
FIG. 1 is a perspective view of the preferred embodiment constructed in accordance with the principles of the present invention.
Figure 2:
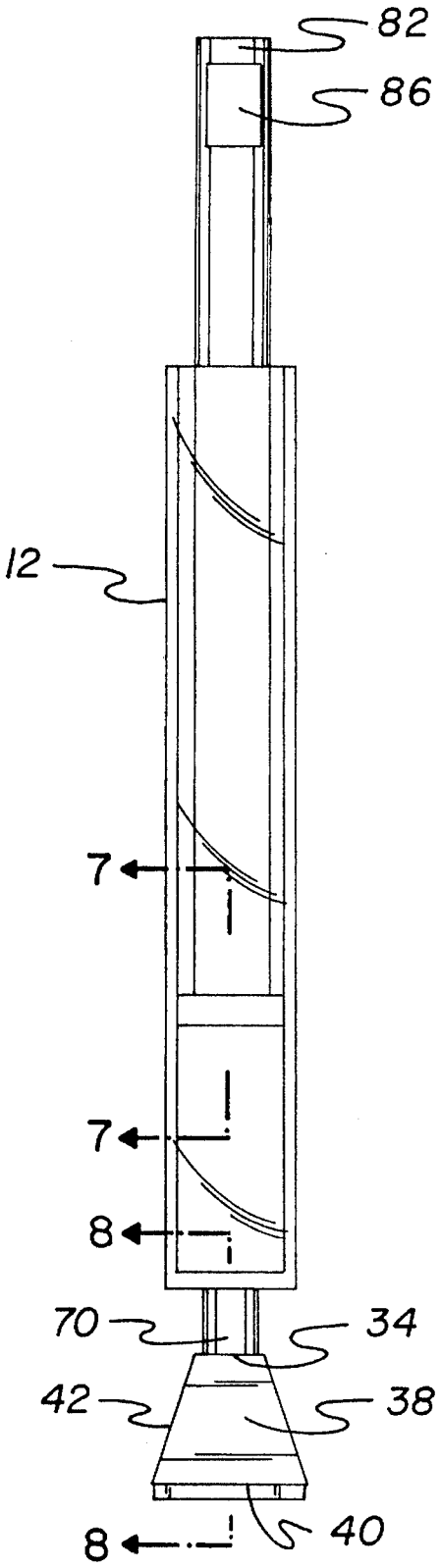
FIG. 2 is a side elevational view of the preferred embodiment of the present invention with its plunger in an extended orientation.
Figure 3:
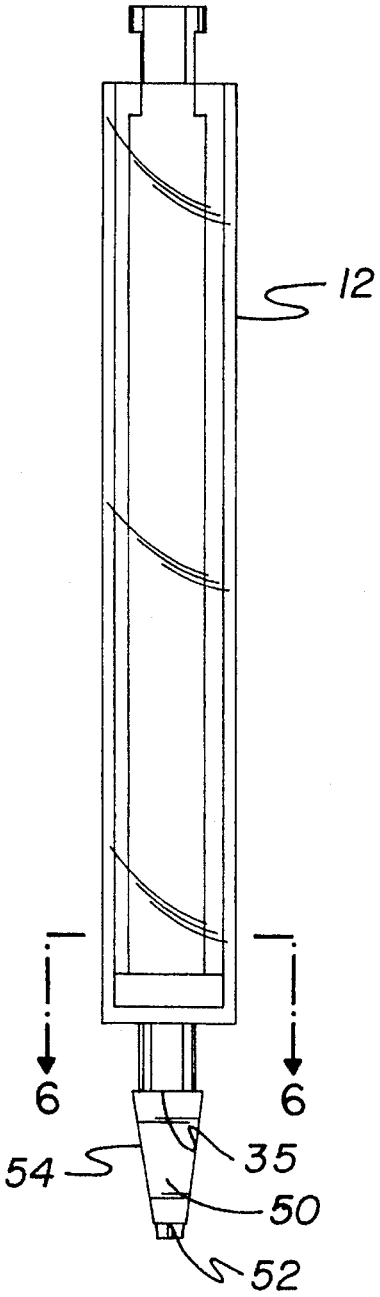
FIG. 3 is another side elevational view of the present invention with its plunger in a retracted orientation.
Figure 4:
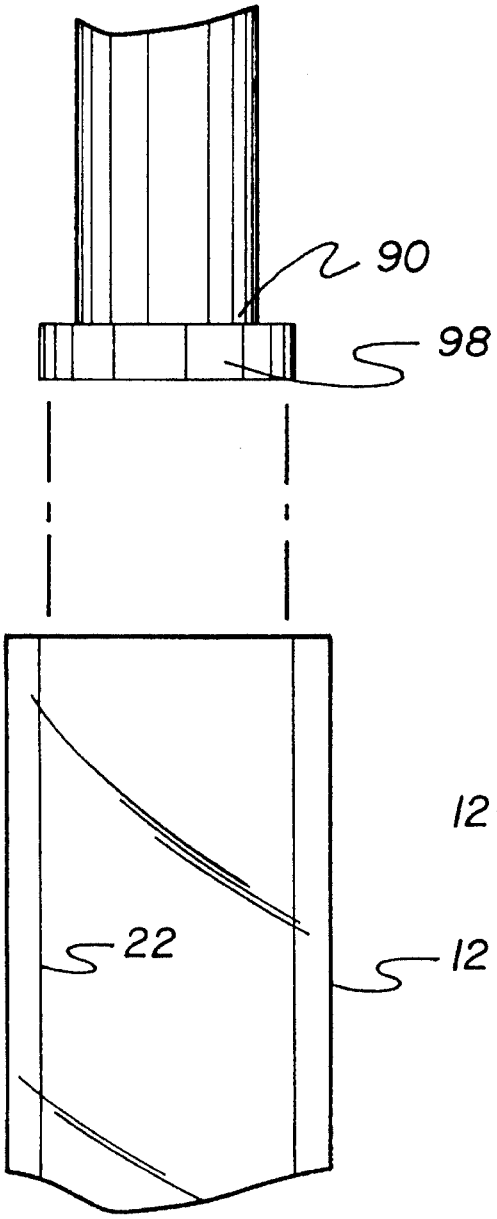
FIG. 4 is a fragmentary view of the slidable and mateable coupling between the container and the plunger.
Figure 5:
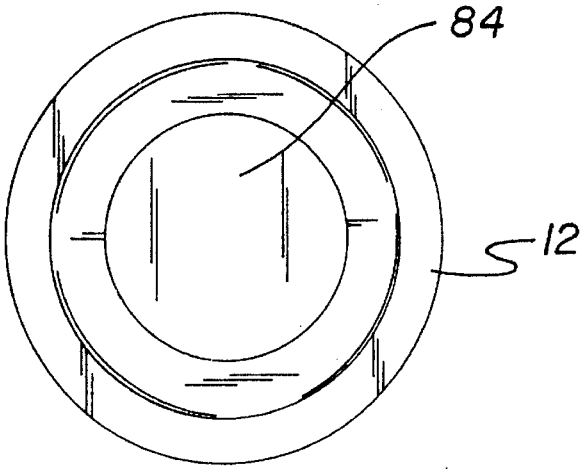
FIG. 5 is a plan view of the preferred embodiment of the present invention.
Figure 6:
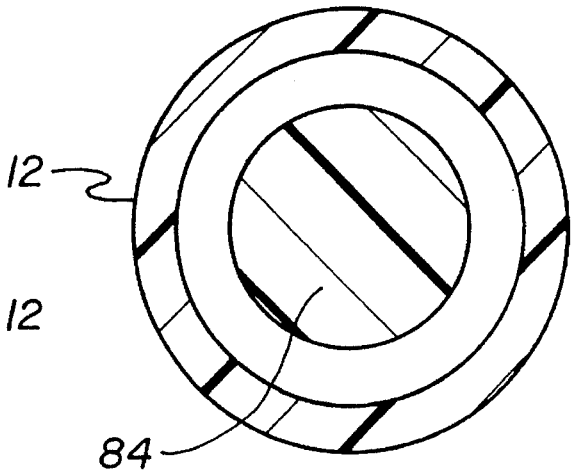
FIG. 6 is a cross-sectional view of the present invention taken along the line 6—6 of FIG. 3.
Figure 7:
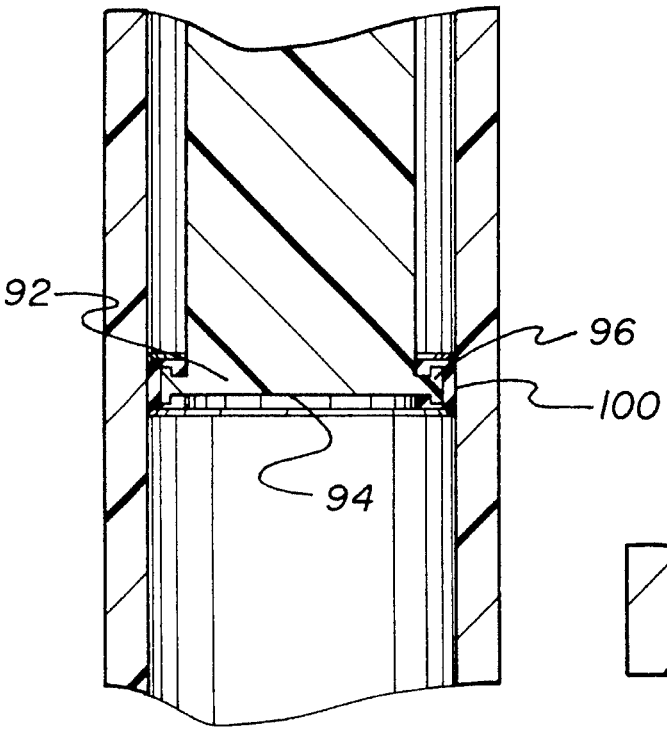
FIG. 7 is a cross-sectional view of the present invention taken along the line 7—7 of FIG. 2.
Figure 8:
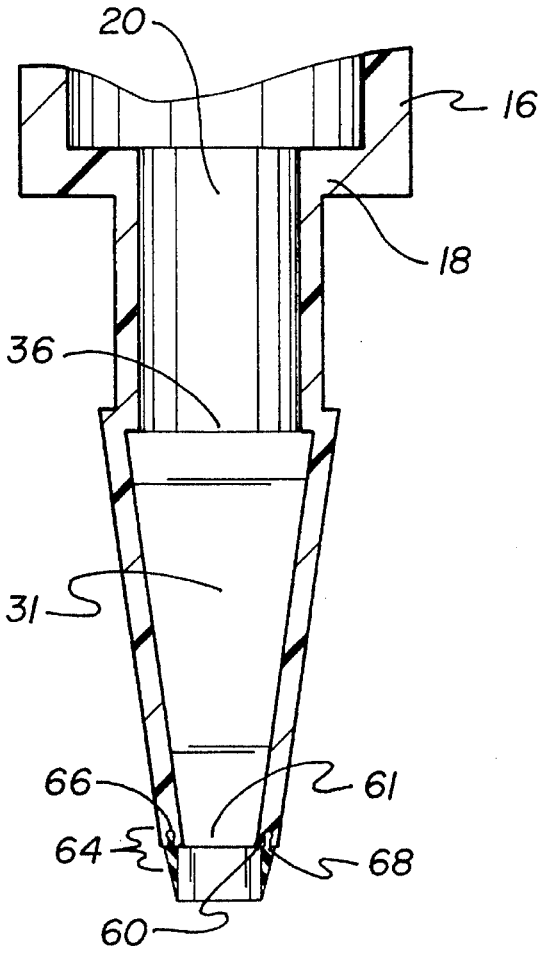
FIG. 8 is a cross-sectional view of the present invention taken along the line 8—8 of FIG. 2.

With reference now to the drawings, and in particular, to FIG. 1 thereof, the preferred embodiment of the new and improved squeegee-type mopping device embodying the principles and concepts of the present invention and generally designated by the reference number 10 will be described.

The preferred embodiment of the present invention comprises a plurality of components. In their broadest context, such components include a container, a head, a neck, and a plunger. Such components are individually configured and correlated with respect to each other to provide a structure that allows a user to suck up spills of liquid 11 using scooping and suctioning action.

Specifically, the present invention includes a container 12. The container is elongated and tubular in structure. It is formed of a rigid plastic material. The container has an upper open end 14 and a lower end 16. The lower end 16 has a radial and inwardly extending flange 18 projected therefrom to create an axial and circular bore 20. The container also has a fixed inner diameter, a smooth interior surface, and a central axis disposed therethrough. In addition, the container has a fixed axial length.

A head 30 is included and aligned along the central axis of the container. The head is formed of a rigid plastic material. The head has an axial length that is about one-seventh the axial length of the container. The head has a hollow interior 31 bounded by an upper wall 32, a pair of long side walls 38, and a pair of end walls 50. The upper wall 32 is planar and rectangular in structure and is positioned in a horizontal plane. The upper wall has an upper surface, a lower surface, and a periphery formed of a pair of opposed long edges 34 and a pair of opposed short edges 35 extended therebetween. The upper wall also has an axially aligned circular bore 36 formed thereon. The bore has a diameter equal to the size of the bore 20. The pair of long side walls 38 are opposed and spaced in symmetric relation to each other. Each long side wall has a trapezoidal-shape. Each long side wall 38 further has a periphery formed of a horizontal short top edge, a horizontal long bottom edge 40, and a pair of angled side edges 42 extended therebetween. The top edge of the long side wall has a length that is less than the inner diameter of the container 12. The bottom edge 40 of the long side wall has a length that is slightly greater than the inner diameter of the container. Each side edge 42 of the long wall is positioned at an angle of about 15–20 degrees offset from the vertical. The top edges of the long walls are interconnected with the long edges 34 of the upper wall 32. The short end walls 50 are opposed and spaced in symmetric relation to each other. Each end wall has a horizontal long top edge interconnected with one of the short edges 35 of the upper wall 32, a horizontal short bottom edge 52 positioned in planar alignment with the bottom edges 40 of the side walls 38, and a pair of side edges 34 extended therebetween. The side edges 34 of each of the end walls 50 are interconnected with the opposing side edges 42 of the opposing side walls 38. The long top edge of each end wall 50 has a length less than the inner diameter of the container. The bottom edges 40 of the side walls 38 and the bottom edges 52 of the end walls 50 create a peripheral lower edge 60 bounding a rectangular opening 61. Opening 61 allows access within the interior 31 of the head. The head additionally includes a flexible foam rubber blade 62. Blade 62 is removably coupled to the lower edge 60 through use of a snap-type fastener 64. The snap-type fastener 64 is formed of a groove 66 on the lower edge 60 and a detent 68 extended from an upper extent of the blade and mated in the groove. The blade is extended downwards and around the opening 61. The blade has a generally triangular cross-section with a lower pointed edge extent. The edge extent is pointed to allow the blade to act in a scooping-type fashion as a user moves the head forwardly along a liquid-covered surface for pushing water into the head for collection.

Interconnected between the lower end 16 of the container 12 and the upper wall 32 of the head 30 is a neck 70. The neck is tubular in structure. It is formed of a rigid plastic material. The neck is aligned along the central axis of the container 12. The neck has an axial length that is half the size of the axial length of the head, an exterior diameter less than the inner diameter of the container, and an inner diameter essentially equal to the diameter of each of the bores 20, 36. The neck allows communication between the container 12 and the head 30 through the bores 20, 36.

Lastly, a plunger 80 is included. The plunger is elongated and tubular in structure. It is formed of a rigid plastic material. The plunger is aligned along the central axis of the container 12. The plunger has an axial length that is between 5–10 percent greater than the axial length of the container 12. The plunger has a fixed diameter of a size between about 2–3 percent less than the inner diameter of the container. The plunger also has an upper end 82 with a flat circular top surface 84 and a crosswise bore 86 with a rectangular cross section disposed therethrough. The bore 86 creates a handle 88 on the upper end 82 that allows a user a firm grip. The plunger also has a lower end 90 with a flange 92 extended radially outwards therefrom. The flange has a flat circular bottom surface 94 and an outer peripheral extent 96 with a T-shaped cross section. A flexible rubber ring 98 is fit around and secured to the peripheral extent 96 of the flange. The lower end 90 of the plunger 80 is slidably disposed within the container with the outer peripheral edge of the rubber ring 98 positioned in facing contact with the interior surface 22 to form a moveable seal 100. The opening 61 of the head 30 is positionable upon a surface covered with liquid 11. Upward extension of the plunger creates a suctioning force for pulling the liquid through the head and into the container. Conversely, downward retraction of the plunger within the container 12 ejects the water from the container and through the opening.

The present invention is a mopping device which soaks up large quantities of spilled liquids without the user's hands becoming wet. The present invention is somewhat smaller in length and girth than a standard mop. The present invention consists of a hollow tubular container with an elongated plunger. This container is large enough to accommodate a large quantity of liquid retrieved through the head. Inside the hollow container is located a small plastic or rubber ring that creates a movable seal that allows suction to be generated. This ring slides up and down within the container allows liquid to be drawn into the container as the handle is pulled upwards. The head of the mop is rectangular and features an opening through which the liquid is drawn. A sponge-like elastomeric material is also located along the base of the head to facilitate the collection of spilled liquid in a scooping fashion like that of a conventional squeegee.

To clean up spilled liquids from vinyl or linoleum floors, the user first places the present invention on a spill and then maneuvers it through the liquid to allow the blade to transfer liquid into the head. During this movement, the handle of the mop is pulled outwards from the container, thereby drawing liquid up through the head of the mop. This process is repeated until the liquid is retrieved. When picking up large quantities of liquid, the container may require emptying by removing the plunger and pouring the contained liquid into a sink or the like. Additionally, the retrieved water can be ejected into the sink by depressing the handle toward the head. The present invention is a convenient household device that quickly and easily picks up large quantities of liquids in a kitchen or bathroom and is ideal for use within other areas where spills often occur.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A squeegee-type mopping device for allowing a user to suck up spills of liquid comprising, in combination:

an elongated rigid plastic tubular container having an upper open end, a lower end with a radial and inwardly extending flange projected therefrom to thereby create an axial circular bore, a fixed inner diameter, a smooth interior surface, a central axis disposed therethrough, and a fixed axial length;

a rigid plastic hollow head aligned along the central axis of the container and with the head having a planar rectangular horizontal upper wall with a pair of opposed long edges, a pair of short edges extended therebetween, and a circular bore formed thereon, a pair of opposed spaced upstanding trapezoidal-shaped long side walls with each long side wall having a short top edge, a long bottom edge, and a pair of side edges extended therebetween and with the top edges thereof interconnected with the long edges of the upper wall, a pair of opposed spaced upstanding trapezoidal-shaped short end walls with each end wall having a long top edge interconnected with one of the short edges of the upper wall, a short bottom edge positioned in planar alignment with the bottom edges of the side walls, and a pair of side edges extended therebetween and with the side edges of each of the end walls interconnected with the opposing side edges of the opposing side walls and with the bottom edges of the side walls and the bottom edges of the end walls creating a peripheral lower edge bounding a rectangular opening that allows access within the head, the head additionally having a flexible foam rubber blade removably coupled to the lower edge through use of a snap-type fastener with the blade extended downwards and around the opening and with the blade further having a generally triangular cross-section with a lower pointed edge extent;

a tubular rigid plastic neck aligned along the central axis of the container and with the neck interconnected between the lower end of the container and the upper wall of the head to allow communication between the container and head through the bores; and an elongated tubular rigid plastic plunger aligned along the central axis of the container and with the plunger having an axial length greater than that of the container, a fixed diameter of a size less than the inner diameter of the container, an upper end with a crosswise bore disposed therethrough to create a handle for allowing a user a firm grip, a lower end with a flange extending radially outwards therefrom, and a flexible rubber ring fit around a peripheral extent of the flange and with the lower end of the plunger slidably disposed within the container with the rubber ring in facing contact with the interior surface of the container to form a moveable seal, the opening of the head positionable upon a surface covered with liquid and with upward extension of the plunger creating a suctioning force for pulling the liquid through the head and into the container and with the downward retraction of the plunger ejecting the water from the container and through the opening.

2. A squeegee-type mopping device comprising:

an elongated tubular rigid container having an open upper end and an open lower end;

a head having a hollow interior, an upper open extent coupled to the lower end of the container to allow communication therebetween, a lower extent having a peripheral lower edge bounding an opening that allows access to the interior, and a planar flexible blade removably coupled to the lower edge and extended downwards therefrom; and an elongated plunger having an upper end and a lower end and with the lower end slidably disposed within the container to form a moveable seal, the opening of the head positionable upon a surface covered with liquid and with extension of the plunger, said device having means for creating a suctioning force for pulling the liquid through the head and into the container and with retraction of the plunger ejecting water from the container and through the opening.

3. The squeegee-type mopping device as set forth in claim 2 where the head includes a planar rectangular horizontal upper wall with a pair of opposed long edges and a pair of short edges, a pair of opposed spaced upstanding trapezoidal-shaped long side walls with each long side wall having a short top edge, a long bottom edge, and a pair of side edges extended therebetween and with the top edges thereof interconnected with the long edges of the upper wall, and a pair of opposed spaced upstanding trapezoidal-shaped short end walls with each end wall having a long top edge interconnected with one of the short edges of the upper wall, a short bottom edge positioned in planar alignment with the bottom edges of the side walls, and a pair of side edges extended therebetween and with the side edges of each of the end walls interconnected with the opposing side edges of the opposing side walls and with the bottom edges of the side walls and the bottom edges of the end walls creating the peripheral lower edge.

4. The squeegee-type mopping device as set forth in claim 2 wherein the blade is connected to the lower edge through use of a snap-type fastener.

5. The squeegee-type mopping device as set forth in claim 2 wherein the blade has a generally triangular cross-section with a lower pointed edge extent.

6. The squeegee-type mopping device as set forth in claim 2 wherein the lower end of the plunger has a flexible ring secured therearound for creating the seal.

7. The squeegee-type mopping device as set forth in claim 2 wherein a crosswise bore is disposed through the upper end of the plunger to thereby create a handle for allowing a user a firm grip.

* * * * *